US011426617B2

(12) United States Patent
Petrillo et al.

(10) Patent No.: US 11,426,617 B2
(45) Date of Patent: Aug. 30, 2022

(54) BRAKING SYSTEM AND METHOD FOR EXERCISE EQUIPMENT

(71) Applicant: Peloton Interactive, Inc, New York, NY (US)

(72) Inventors: David William Petrillo, New York, NY (US); Thomas Philip Cortese, Brooklyn, NY (US)

(73) Assignee: Peloton Interactive, Inc., New York, NY (US)

( * ) Notice: Subject to any disclaimer, the term of this patent is extended or adjusted under 35 U.S.C. 154(b) by 0 days.

(21) Appl. No.: 16/251,023

(22) Filed: Jan. 17, 2019

(65) Prior Publication Data

US 2019/0217144 A1 Jul. 18, 2019

Related U.S. Application Data

(60) Provisional application No. 62/618,581, filed on Jan. 17, 2018.

(51) Int. Cl.
*A63B 21/22* (2006.01)
*A63B 22/06* (2006.01)
(Continued)

(52) U.S. Cl.
CPC .... *A63B 21/00192* (2013.01); *A63B 21/0051* (2013.01); *A63B 21/00069* (2013.01);
(Continued)

(58) Field of Classification Search
CPC ..... A63B 21/00047; A63B 21/00058; A63B 21/00069; A63B 21/00072; A63B 21/00076; A63B 21/00192; A63B 21/005; A63B 21/0051; A63B 21/0052; A63B 21/0053; A63B 21/0054; A63B 21/0055; A63B 21/0056; A63B 21/0057; A63B 21/0058; A63B 21/012; A63B 21/0125; A63B 21/015; A63B 22/06;
(Continued)

(56) References Cited

U.S. PATENT DOCUMENTS 8,950,276 B2 * 2/2015 Wu ..... G01L 3/101 73/862.08
9,839,807 B2 * 12/2017 Golesh ..... A63B 21/0051
(Continued)

*Primary Examiner* — Nyca T Nguyen
*Assistant Examiner* — Zachary T Moore
(74) *Attorney, Agent, or Firm* — Haynes and Boone, LLP

(57) ABSTRACT

Resistance mechanism and method for an exercise cycle includes an adjusting bracket having magnets mounted on its inner surface and spaced from a flywheel, an adjustment shaft having a threaded rod rotatably disposed through a tubular sleeve disposed on a frame and above the adjustment bracket, a threaded member mounted on the adjustment bracket and connected the threaded rod, and a linking assembly mounting the adjustment bracket to the frame, and including a first member, a first linking member, a first sensor, and a second sensor. The first sensor is disposed on the first member adjacent to the first end of the first linking member, a second sensor is disposed on the first linking member adjacent to the first sensor. A relative position of the first sensor and the second sensor is changed with respect to the corresponding movements of the adjusting bracket.

19 Claims, 8 Drawing Sheets

(51) Int. Cl.
*A63B 21/005* (2006.01)
*A63B 71/06* (2006.01)
*A63B 21/00* (2006.01)

(52) U.S. Cl.
CPC ..... *A63B 21/225* (2013.01); *A63B 22/0605* (2013.01); *A63B 2071/0658* (2013.01); *A63B 2220/17* (2013.01); *A63B 2220/30* (2013.01); *A63B 2220/34* (2013.01); *A63B 2220/833* (2013.01); *A63B 2220/89* (2013.01); *A63B 2225/20* (2013.01); *A63B 2225/50* (2013.01); *A63B 2225/52* (2013.01); *A63B 2230/06* (2013.01); *A63B 2230/40* (2013.01); *A63B 2230/65* (2013.01); *A63B 2230/75* (2013.01)

(58) Field of Classification Search
CPC ..... A63B 22/0605; A63B 22/0664; A63B 22/0694; A63B 22/18; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688; A63B 2022/185; A61G 5/1024; F01L 2001/3522; G01L 3/16; G01L 3/18; G01L 3/20; G01L 3/205; G01L 3/22
See application file for complete search history.

(56) References Cited

U.S. PATENT DOCUMENTS

| | | | | |
|---|---|---|---|---|
| 10,272,280 | B2 * | 4/2019 | Leonardi | A63B 21/225 |
| 10,369,416 | B2 * | 8/2019 | Huang | A63B 22/0605 |
| 2012/0088637 | A1 * | 4/2012 | Lull | A63B 21/015 482/57 |
| 2016/0152301 | A1 * | 6/2016 | Bortoli | B62M 9/124 474/82 |
| 2017/0312580 | A1 * | 11/2017 | Chang | G01L 1/12 |
| 2017/0319906 | A1 * | 11/2017 | Chang | G01L 3/22 |
| 2018/0369642 | A1 * | 12/2018 | Chang | A63B 21/00069 |

* cited by examiner (Rear)

(Rear Perspective)

(Front Perspective)

(Front)

(Bottom)

(Top)

BRAKING SYSTEM AND METHOD FOR EXERCISE EQUIPMENT

CROSS-REFERENCE TO RELATED APPLICATIONS

This application claims priority to and the benefit of U.S. Provisional Patent Application Ser. No. 62/618,581, filed Jan. 17, 2018, and entitled "BRAKING SYSTEM AND METHOD FOR EXERCISE EQUIPMENT," which is hereby incorporated by reference in its entirety.

TECHNICAL FIELD

The present application relates generally to the field of exercise equipment, and more specifically for example, to systems and methods for sensing and/or adjusting resistance in exercise equipment.

BACKGROUND

Modern fitness equipment is often configured to allow a user to make one or more adjustments to the fitness equipment according to their personal training needs. The adjustment operation in some fitness equipment is difficult and cumbersome for many users, particularly during exercise. For example, an exercise cycle may be configured with a torque regulator, allowing a user to adjust the pedal resistance by adjusting a degree of torque applied to a flywheel. One drawback with conventional adjustment approaches is that it may be difficult, and time consuming for the user to accurately set the appropriate resistance, inconveniencing the user and negatively impacting the exercise experience. There is therefore a need for improved systems and methods for operating exercise equipment that increases the convenience to the user and enhances the exercise experience.

SUMMARY

The present disclosure, provides various systems and methods for sensing and adjusting torque in exercise equipment. In some embodiments, a bracket and sensor system allow for linear adjustment of braking magnets in relation to a flywheel. The bracket directly accepts user adjustment of an adjustment shaft through a fixed nut tube. A linkage assembly guides the bracket in an approximately linear path and absorbs the reaction forces generated by the magnetic brake and the manually operated friction brake. The bracket and linkage assembly include a sensor arrangement providing feedback regarding the position of the magnetic brake.

In various embodiments, a resistance mechanism and method for an exercise cycle includes an adjusting bracket having magnets mounted on its inner surface and spaced from a flywheel, an adjustment shaft having a threaded rod rotatably disposed through a tubular sleeve disposed on a frame and above the adjustment bracket, a threaded member mounted on the adjustment bracket and connected the threaded rod, and a linking assembly mounting the adjustment bracket to the frame, and including a first member, a first linking member, a first sensor, and a second sensor. The first sensor is disposed on the first member adjacent to the first end of the first linking member, a second sensor is disposed on the first linking member adjacent to the first sensor. A relative position of the first sensor and the second sensor is changed with respect to the corresponding movements of the adjusting bracket.

The scope of the present disclosure is defined by the claims, which are incorporated into this section by reference. A more complete understanding of the present disclosure will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

DETAILED DESCRIPTION

Figure 1:
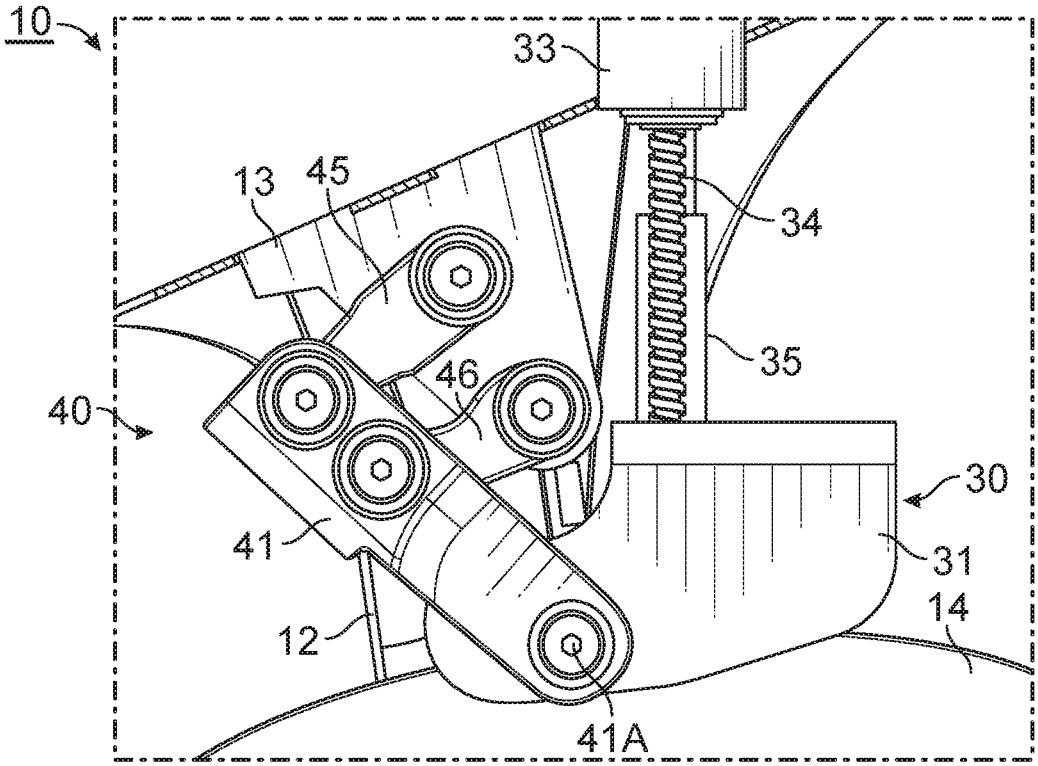
FIG. 1 is a partial plan view of an exemplary braking system in accordance with one or more embodiments of the present disclosure.

In accordance with various embodiments of the present disclosure, systems and methods for sensing and adjusting torque in exercise equipment are provided. The embodiments disclosed herein comprise a bracket and sensor system allowing for linear adjustment of braking magnets in relation to a flywheel. The bracket directly accepts user adjustment of an adjustment shaft through a fixed nut tube. A linkage assembly guides the bracket in an approximately linear path and absorbs the reaction forces generated by the magnetic brake and the manually operated friction brake.

The bracket and linkage assembly include a sensor arrangement providing feedback regarding the position of the magnetic brake.

Referring to FIGS. 1-5, exemplary embodiments of a braking system for an exercise apparatus will now be described. In the illustrated embodiment, the braking system 10 is provided for an exercise cycle that includes a torque sensing apparatus that can reduce the adjustment effort and shorten the sensing time, thereby increasing the convenience of the operation for the user.

The braking system 10 includes a torque adjusting unit 30 and a linkage assembly 40. The torque adjusting unit 30 includes an adjusting bracket 31, tubular sleeve 33, adjusting shaft 34 and a threaded nut tube 35. The adjusting bracket 31 is disposed around a periphery of a flywheel 14, with one end of the adjusting bracket 31 attached to a linkage assembly 40. The tubular sleeve 33 is disposed on the frame 12 and is located above the adjusting bracket 31. The adjusting shaft 34 passes through the tubular sleeve 33 and includes a threaded portion formed thereon. The threaded nut tube 35 is threaded to engage the threaded portion of the adjusting shaft 34, thereby driving the adjusting bracket 31 up and down relative to the flywheel 14.

The linkage assembly 40 includes a connecting member 41, a first sensing member 42, a second sensing member 43, a first linking member 45, and a second linking member 46. One end of the connecting member 41 is mounted to the adjusting bracket 31. The nut tube 35 is mounted on the adjusting bracket 31 and engaged with the threaded portion of the adjusting shaft 34 connecting the connecting member 41 to the adjusting shaft through adjusting bracket 31. The first sensing member 42 and the second sensing member 43 are correspondingly disposed on the connecting member 41 and the second linking member 46, respectively.

By rotating the adjusting shaft 34 (e.g., through a rotatable knob disposed on one end of the adjusting shaft 34) the nut tube 35 is driven to axially move up and down along the threaded portion of the adjusting shaft 34. When the nut tube 35 is moved, the adjusting bracket 31 is biased relative to the flywheel 14, such that magnetic flux between a pair of magnetic members, such as magnets 32, disposed on opposite sides of the flywheel is changed, providing resistance to the flywheel. When the nut tube 35 is moved, the connecting member 41 adjusts accordingly. When rotatably driven by the adjusting shaft 34, the nut tube 35 is driven to orient toward or away from the tubular sleeve 33 such that a distance and orientation between the first sensing member 42 disposed on the connecting member and second sensing member 43 disposed on the second linking member is changed, generating sensing signals to a control panel for allowing the user to acquire the changes in resistance value.

In one embodiment, one of the first sensing member 42 and second sensing member 43 is sensor adapted to sense proximity from the other sensing member (for example, a Hall sensor and a magnet). In various embodiments, the first sensing member 42 may include a 2D or 3D Hall effect sensor mounted on the connecting member 41 and the second sensing member 43 may include a diametrically or radially magnetized magnet which may be embedded (or otherwise mounted on) the second linking member 46. The first sensing member 42 may generate digital signals representing the angular displacement of the second sensing member 43 relative to the first sensing member 42. The signals may be transmitted to the bike's processing system (e.g., via digital $I^2C$ protocol) for further reporting and processing. For example, the processing system may store data and/or logic to determine and/or calculate positions of the resistance mechanism (e.g., magnets) relative to the flywheel and/or corresponding resistance values from the received sensor signals. In some embodiments, a linear adjustment of the magnets relative to the flywheel may produce a corresponding angular displacement of the second sensing member relative to the first sensing member, which generates digital signals that are received by the processing system. A correlation between the received sensor signals, the position of a resistance mechanism (e.g., magnets relative to a flywheel) and/or resistance values may be determined during a testing stage and programmed and/or configured into the processing system to produce appropriate data during operation.

In view of the foregoing, it can be seen that the braking system 10 of the present embodiment includes a linkage assembly including a connecting member 41, a first linking member 45, and a second linking member 46, arranged to allow the adjusting bracket 31 and the connecting member 41 to change the distance and/or angle between the first sensing member 42 and the second sensing member 43 while providing resistance to the flywheel. In this arrangement, the first sensing member 42 may output a corresponding sensing signal for further processing or to provide feedback to the user.

Figure 2:
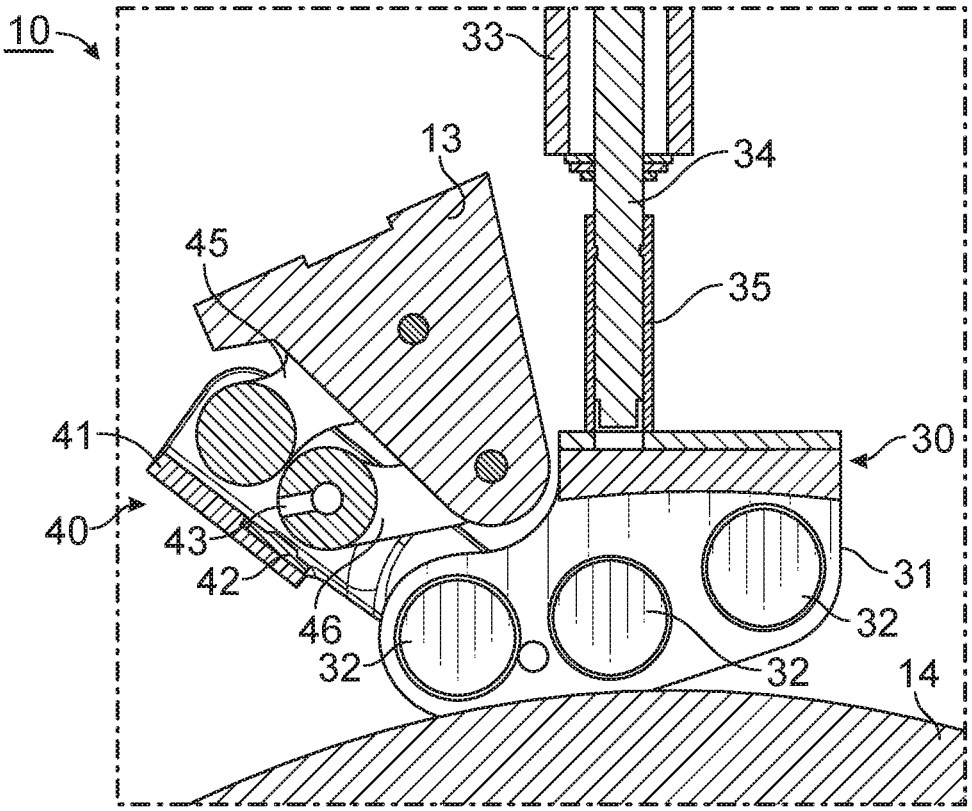
FIG. 2 is a cross section view of an exemplary braking system in accordance with one or more embodiments of the present disclosure.
Figure 3:
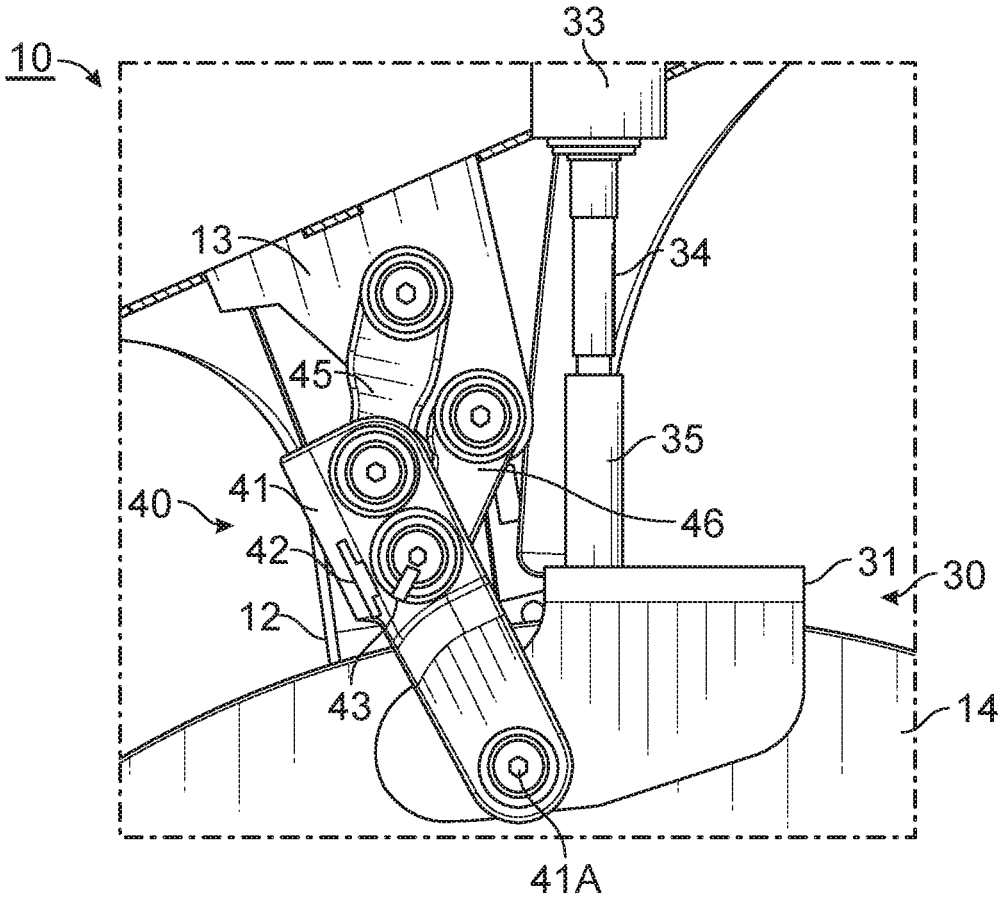
FIG. 3 is a partial plan view of an exemplary braking system in accordance with one or more embodiments of the present disclosure.
Figure 4B:
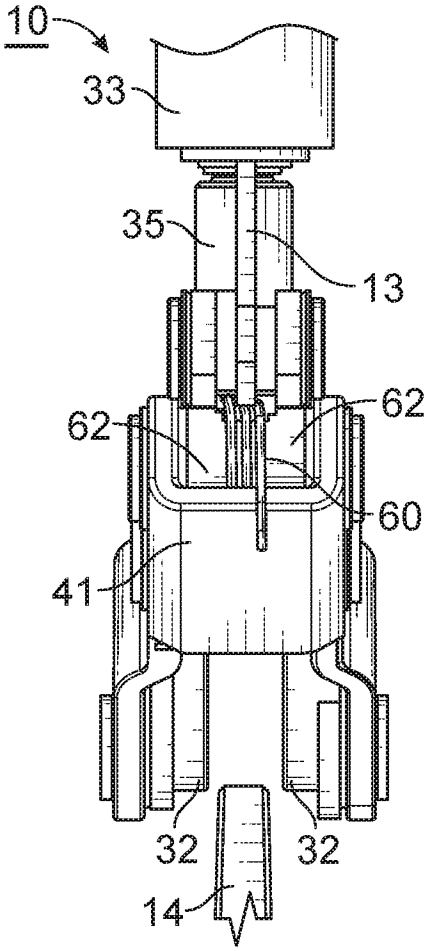
FIG. 4B is a rear view of an exemplary braking system in accordance with one or more embodiments of the present disclosure.
Figure 4A:
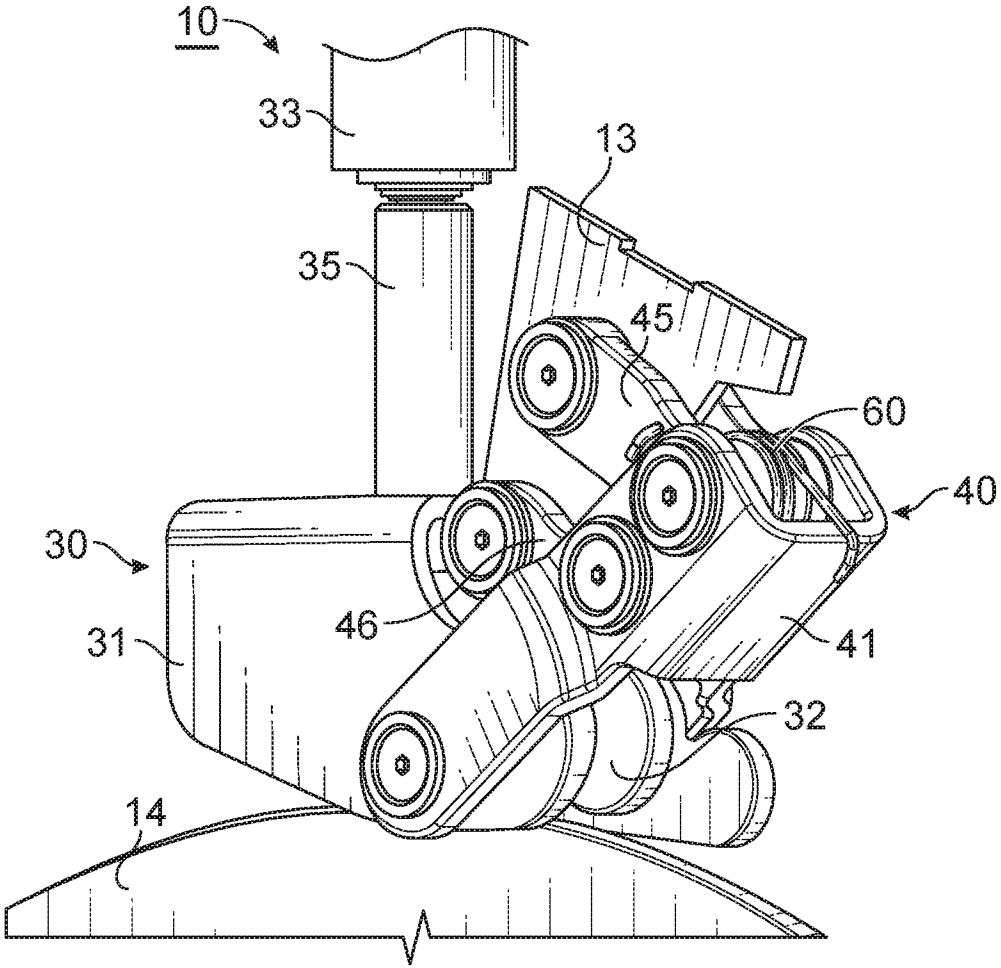
FIG. 4A is a rear perspective view of an exemplary braking system in accordance with one or more embodiments of the present disclosure.
Figure 4C:
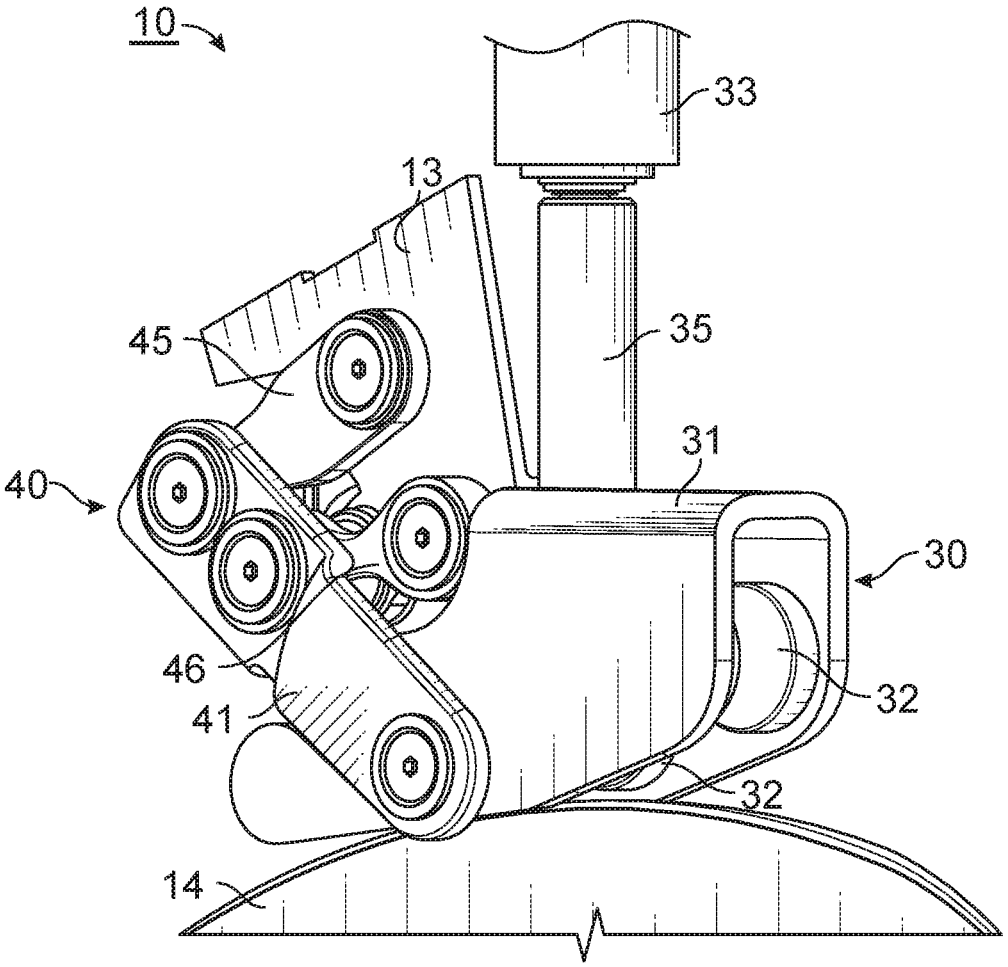
FIG. 4C is a front perspective view of an exemplary braking system in accordance with one or more embodiments of the present disclosure.
Figure 4D:
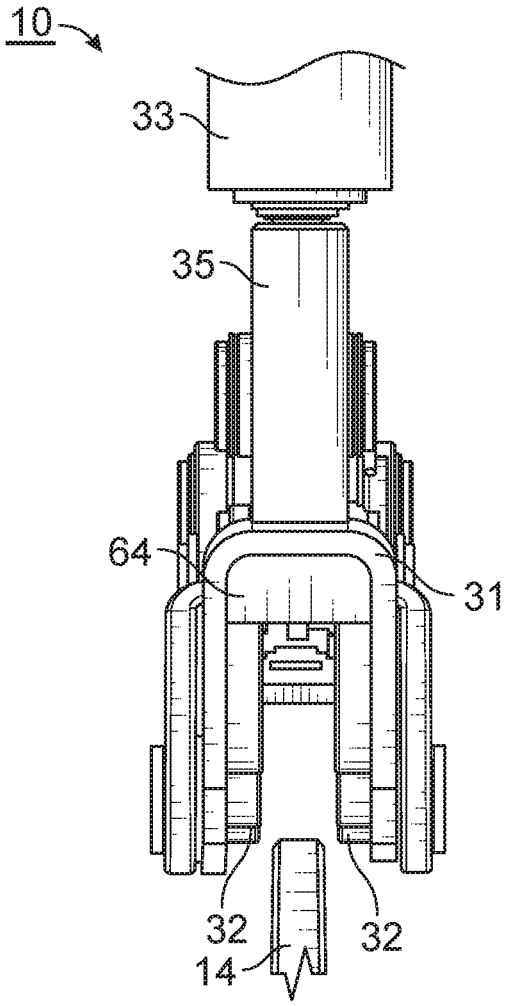
FIG. 4D is a front view of an exemplary braking system in accordance with one or more embodiments of the present disclosure.
Figure 4E:
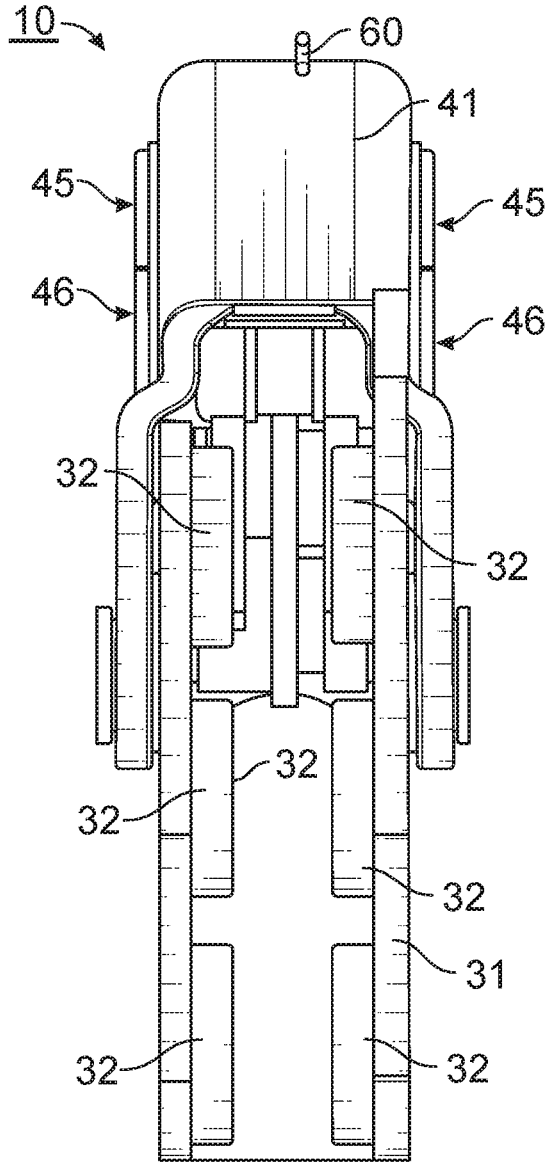
FIG. 4E is a bottom view of an exemplary braking system in accordance with one or more embodiments of the present disclosure.
Figure 4F:
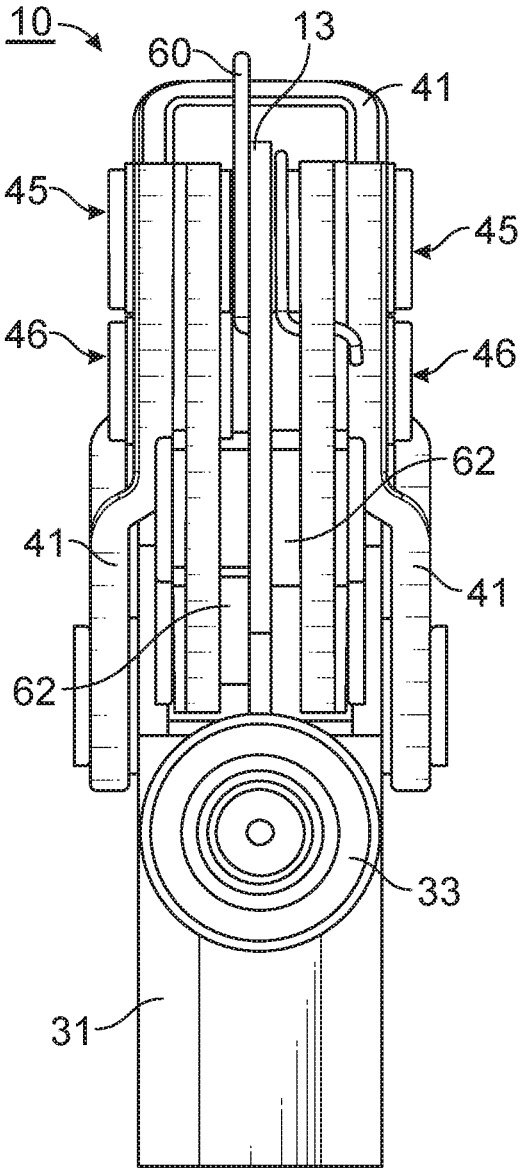
FIG. 4F is a top view of an exemplary braking system in accordance with one or more embodiments of the present disclosure.

Additional details will now be described with reference to the figures. Referring to FIG. 2, the first sensing member 42, the second sensing member 43 and magnets 32 on one side of the adjusting bracket 31 are shown. Each magnet 32 has a corresponding magnet 32 on the opposite side of the adjusting bracket 31. FIG. 3 illustrates the embodiment of FIG. 1 with the adjusting bracket 31 in a second position relative to the flywheel 14, and a corresponding rotation of the second sensing member 43 relative to the first sensing member 42.

As discussed, the exercise cycle includes the frame 12 and a flywheel 14 operably connected to allow a user to rotate the flywheel 14 as the user pedals the exercise cycle. The torque adjusting unit 30 includes an adjusting bracket 31 that is connected to the linkage assembly 40, which facilitates the adjustment of the adjusting bracket while maintaining the magnets 32, which are disposed inside the adjusting bracket 31, aligned a predetermined distance from the flywheel 14.

Referring to FIGS. 4A-4F, the linkage assembly 40 will be described in further detail. The connecting member 41 and the adjusting bracket 31 are attached via a first linking member 45, a second linking member 46 and a mounting bracket 13. A first end of the connecting member 41 is mounted to the adjusting bracket 31. A second end of the connecting member 41 is mounted to the mounting bracket 13 through each of the first linking member 45 and the second linking member 46. A first end of the first linking member 45 is mounted to the mounting bracket 13, and a second end of the first linking member 45 is mounted to the second end of the connecting member 41. A first end of the second linking member 46 is mounted to the mounting bracket 13 adjacent to the first linking member 45, and the second end of the second linking member 46 is mounted to the connecting member 41 adjacent to the first linking member 45. In various embodiments, the mountings may include bushings 62, washers, bolts and other hardware components. In some embodiments, a torque spring 60 is provided to bias the torque assembly towards an upward position (no resistance) absent downward force applied by the adjusting shaft 34.

As shown, when the adjusting shaft 34 is rotated (e.g., via a knob turned by the user) the adjusting shaft 34 is driven via the threaded portion. The threaded nut tube 35 is vertically displaced along the axial direction of the adjusting shaft 34. The threaded nut tube 35 will cause the adjusting bracket 31 to move relative to the flywheel 14 so that the adjusting bracket 31 is able to utilize the magnetic flux change between each pair of magnets 32 and the flywheel 14. In one or more embodiments, a brake pad 64 is disposed in the adjusting bracket 31 to apply additional resistance to the flywheel 14 when the adjusting bracket 31 is pushed down onto the flywheel 14 by the adjusting shaft 34.

Figure 5:
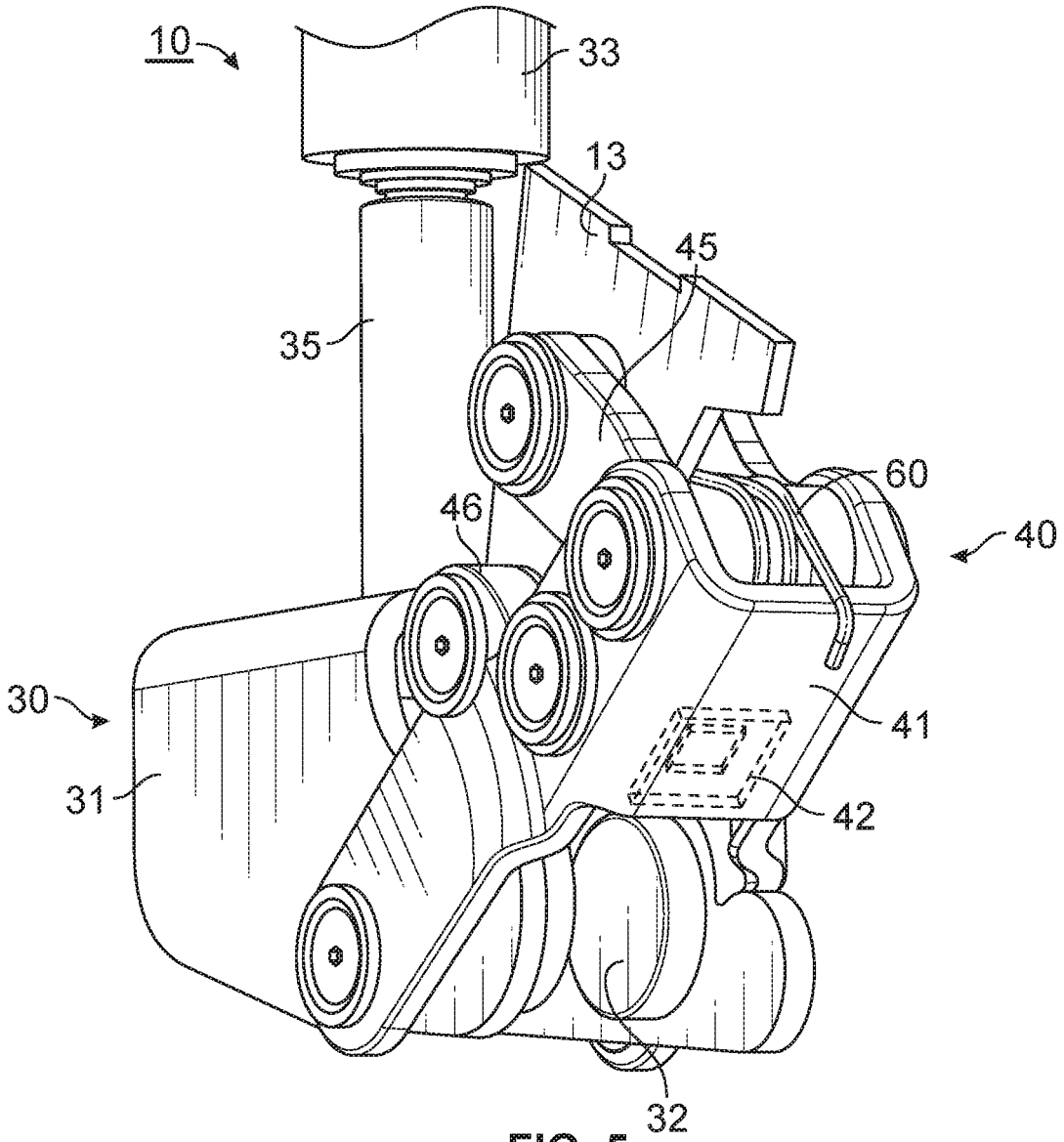
FIG. 5 is a rear perspective view of an exemplary braking system in accordance with one or more embodiments of the present disclosure.

During adjustment, the connecting member 41 is deflected with respect to the adjusting bracket 31, the first linking member 45 and the second linking member 46. In this manner, the distance between the first sensing member 42 and the second sensing member 43, and the angle of the second sensing member 43, change relative to the movement of the connecting member 41 and the adjusting bracket 31. As the relative positions change, the first sensing member 42 (or the second sensing member 43, in various configurations) can generate a corresponding sense signal to a control panel allowing the user to know the torque based on the message displayed on the control panel. Referring to FIG. 5, an arrangement of the first sensing member 42 is illustrated in accordance with an embodiment of the present disclosure.

Figure 6:
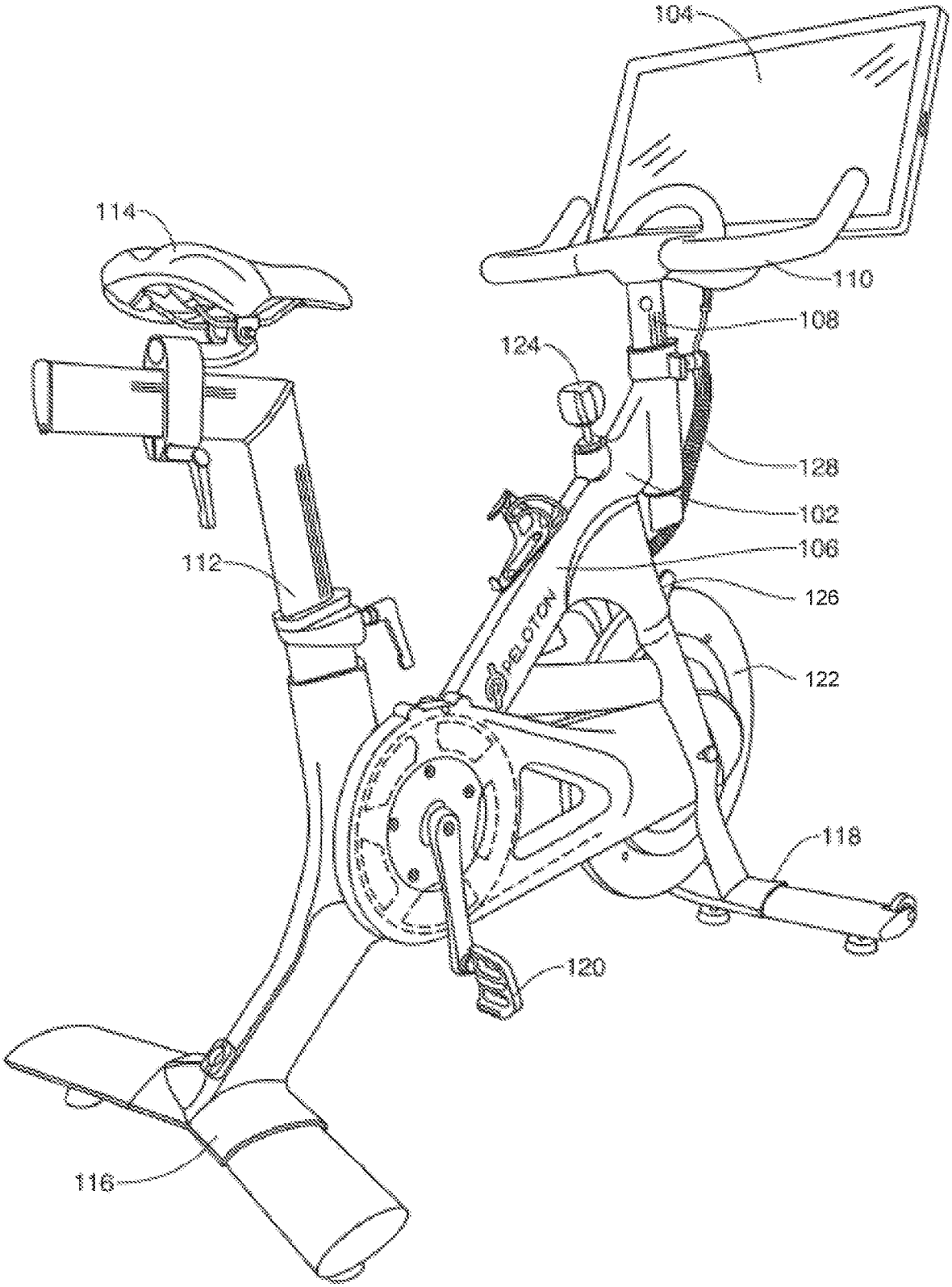
FIG. 6 is a diagram of an exemplary exercise apparatus implementing an exemplary braking system in accordance with one or more embodiments of the present disclosure.

Referring FIG. 6, an exemplary exercise apparatus is shown including an embodiment of the braking system disclosed herein. As shown, a stationary bike 102 includes integrated or connected digital hardware including a display screen 104.

In various exemplary embodiments, a stationary bike 102 may comprise a frame 106, a handlebar post 108 to support the handlebars 110, a seat post 112 to support the seat 114, a rear support 116 and a front support 118. Pedals 120 are used to drive a flywheel 122 via a belt, chain, or other drive mechanism. The flywheel 122 may be a heavy metal disc or other appropriate mechanism. In various exemplary embodiments, the force on the pedals necessary to spin the flywheel 122 can be adjusted using a resistance adjustment knob 124 which adjusts a resistance mechanism 126, such as the braking system disclosed herein. The resistance adjustment knob may rotate an adjustment shaft to control the resistance mechanism 126 to increase or decrease the resistance of the flywheel 122 to rotation. For example, rotating the resistance adjustment knob clockwise may cause a set of magnets of the resistance mechanism 126 to move relative to the flywheel 122, increasing its resistance to rotation and increasing the force that the user must apply to the pedals 120 to make the flywheel 122 spin.

The stationary bike 102 may also include various features that allow for adjustment of the position of the seat 114, handlebars 110, etc. In various exemplary embodiments, a display screen 104 may be mounted in front of the user forward of the handlebars. Such display screen may include a hinge or other mechanism to allow for adjustment of the position or orientation of the display screen relative to the rider.

The digital hardware associated with the stationary bike 102 may be connected to or integrated with the stationary bike 102, or it may be located remotely and wirelessly connected to the stationary bike. The digital hardware may be integrated with a display screen 104 which may be attached to the stationary bike or it may be mounted separately, but should be positioned to be in the line of sight of a person using the stationary bike. The digital hardware may include digital storage, processing, and communications hardware, software, and/or one or more media input/output devices such as display screens, cameras, microphones, keyboards, touchscreens, headsets, and/or audio speakers. In various exemplary embodiments these components may be integrated with the stationary bike. All communications between and among such components may be multichannel, multi-directional, and wireless or wired, using any appropriate protocol or technology. In various exemplary embodiments, the system may include associated mobile and web-based application programs that provide access to account, performance, and other relevant information to users from local or remote personal computers, laptops, mobile devices, or any other digital device.

In various exemplary embodiments, the stationary bike 102 is equipped with various sensors that can measure a range of performance metrics from both the stationary bike and the rider, instantaneously and/or over time. For example, the resistance mechanism 126 may include sensors providing resistance feedback on the position of the resistance mechanism. The stationary bike may also include power measurement sensors such as magnetic resistance power measurement sensors or an eddy current power monitoring system that provides continuous power measurement during use. The stationary bike may also include a wide range of other sensors to measure speed, pedal cadence, flywheel rotational speed, etc. The stationary bike may also include sensors to measure rider heart-rate, respiration, hydration, or any other physical characteristic. Such sensors may communicate with storage and processing systems on the bike, nearby, or at a remote location, using wired (such as view wired connection 128) or wireless connections.

Hardware and software within the sensors or in a separate processing system may be provided to calculate and store a wide range of status and performance information. Relevant performance metrics that may be measured or calculated include resistance, distance, speed, power, total work, pedal cadence, heart rate, respiration, hydration, calorie burn, and/or any custom performance scores that may be developed. Where appropriate, such performance metrics can be calculated as current/instantaneous values, maximum, minimum, average, or total over time, or using any other statistical analysis. Trends can also be determined, stored, and displayed to the user, the instructor, and/or other users. A user interface may be provided for the user to control the language, units, and other characteristics for the information displayed.

Advantages of the present embodiment will be apparent to those skilled in the art, including that embodiments disclosed herein can effectively achieve the reduction of user action and shorten the sensing time.

In one or more embodiments, a resistance system for an exercise cycle having a frame and a flywheel includes an adjusting bracket, a tubular sleeve disposed on the frame and above the adjusting bracket, an adjusting shaft, a threaded member, and a linking assembly. The adjusting bracket may be disposed at the periphery of the flywheel and include at least two magnetic members mounted on an inner surface of the adjusting bracket and respectively spaced from the flywheel. The tubular sleeve may be disposed on the frame and above the adjusting bracket. An adjusting shaft includes a threaded rod rotatably disposed through the tubular sleeve. The threaded member may be mounted on the adjusting bracket and connected to the threaded rod. The magnet members may apply a resistance to the flywheel when the adjusting bracket is in a lowered position.

The linking assembly connects one end of the adjusting bracket to the frame, and includes a first connecting member, a first linking member, a first sensing member and a second sensing member. The first connecting member includes a first end connected to the adjusting bracket and a second end connected to a first end of the first linking member. The first linking member includes a second end connected to a mounting bracket which may be connected to the frame. The first sensor (e.g., a 2D or 3D Hall-effect sensor) may be disposed on the first connecting member adjacent to the first end of the first linking member. The second sensor (e.g., a diametrically or radially magnetized magnet) may be disposed on the first linking member adjacent to the first sensor. In operation, the relative position of the first sensing member and the second sensing member is changed with respect to the corresponding movements of the adjusting bracket. In some embodiments, the linking assembly includes a pair of first linking members and a pair of second linking members, with each of the second linking members connected to a corresponding first linking member at a first end and connected to the mounting bracket at a second end.

In various embodiments, the adjusting bracket includes a brake pad disposed to apply a resistance to the flywheel when the adjusting bracket is pushed into the flywheel by the adjusting shaft. A knob may be disposed at an end of the adjusting shaft to facilitate manual rotation of the adjusting shaft to raise and lower the adjusting bracket.

In one or more embodiments, a method of adjusting resistance in an exercise cycle having a frame and a flywheel, includes rotating an adjusting shaft, adjusting resistance applied to the flywheel, adjusting a connecting member in response to the rotating, and sensing a position of the connecting member relative to a first linking member. The adjusting shaft may include a threaded rod engaged at one end with a threaded member which moves an adjustment bracket towards or away from the flywheel in response to the rotating. Adjusting resistance applied to the flywheel may be in response to the rotating, wherein the resistance is adjusted based on the relative position of the adjustment bracket to the flywheel. Adjusting the connecting member in response to the rotating may include adjusting the connecting member, which may be attached to the adjusting bracket and the first linking member, which may be mounted to a mounting bracket. Sensing a position of the connecting member relative to the first linking member may include sensing a position that corresponds to the adjusted resistance.

In various embodiments, adjusting resistance may further include disposing a pair of magnetic members on an inner surface of the adjusting bracket, the magnetic members spaced from the flywheel by a distance. Adjusting resistance may further include adjusting the adjusting bracket creating magnetic flux between the pair of magnetic members disposed on opposite sides of the flywheel. Adjusting the connecting member may further include connecting the first linking member to a mounting bracket connected to the frame. Sensing a position of the connecting member relative to the linking member may include sensing, using a first sensing member (e.g., 2D or 3D Hall-effect sensor) disposed on the first connecting member, a change in position of a second sensing member (e.g., a diametrically or radially magnetized magnet), disposed on the first linking member adjacent to the first sensing member. The method may further include transmitting information corresponding to the sensed position to a processing system. In various embodiments, the method may further include disposing a brake pad on an inner surface of the adjusting bracket and rotating the adjusting shaft to apply a resistance to the flywheel by pushing the brake pad into the flywheel. Adjusting the resistance may further include manually turning a knob disposed at an end of the adjustment shaft.

The foregoing disclosure is not intended to limit the present invention to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize advantages over conventional approaches and that changes may be made in form and detail without departing from the scope of the present disclosure.

What is claimed is:

1. A resistance system for an exercise cycle having a frame and a flywheel, the resistance system comprising:

an adjusting bracket disposed at a periphery of the flywheel, the adjusting bracket comprising at least two magnetic members mounted on an inner surface of the adjusting bracket and respectively spaced from the flywheel by a distance;

a tubular sleeve disposed on the frame and above the adjusting bracket;

an adjustment shaft comprising a threaded rod rotatably disposed through the tubular sleeve;

a threaded member mounted on the adjusting bracket and connected to a threaded portion of the threaded rod of the adjusting shaft; and a linking assembly connecting the adjusting bracket to the frame, the linking assembly comprising a first connecting member, a first linking member, a sensor, and a magnet;

wherein the first connecting member includes a first end connected to the adjusting bracket, and a second end rotatably connected to a first distal end of the first linking member;

wherein the first linking member has a second end rotatably connected to the frame;

wherein the sensor is disposed on the first connecting member adjacent to the first distal end of the first linking member;

wherein the magnet is disposed on the first distal end of the first linking member adjacent to the sensor;

wherein the sensor is configured to sense an angular displacement of the magnet relative to the sensor corresponding to a position of the adjusting bracket; and wherein the first linking member is a pair of first linking members and the linking assembly further comprises a pair of second linking members, each mounted to the first connecting member at the first end and mounted to the frame and/or a mounting bracket connected to the frame at the second end.

2. The resistance system of claim 1 wherein the two magnet members apply a resistance to opposite sides of the flywheel based on a position of the adjusting bracket to the flywheel and wherein the sensed angular displacement corresponds to the applied resistance.

3. The resistance system of claim 1 wherein the adjusting bracket includes a brake pad disposed to apply a resistance to the flywheel when the adjusting bracket is pushed into the flywheel by the adjustment shaft.

4. The resistance system of claim 1 further comprising a knob disposed at an end of the adjustment shaft and facilitating manual rotation of the adjustment shaft to raise and lower the adjusting bracket resulting in a corresponding adjustment of resistance applied to the flywheel.

5. The resistance system of claim 1 further comprising a mounting bracket connected to the frame, wherein connecting the second end of the first linking member to the frame comprises mounting the second end of the first linking member to the mounting bracket.

6. The resistance system of claim 1 wherein the sensor is a Hall-effect sensor and/or the magnet is a diametrically magnetized magnet.

7. An exercise cycle comprising the resistance system of claim 1.

8. A method of adjusting resistance in an exercise cycle having a frame and a flywheel, the method comprising:

rotating an adjustment shaft comprising a threaded rod engaged at a first end with a threaded member, wherein the threaded member selectively positions an adjustment bracket relative to the flywheel in response to the rotating;

adjusting a connecting member in response to the rotating, the connecting member rotatably connected to the adjustment bracket and rotatably connected to a distal end of a first linking member, wherein the first linking member is rotatably connected to the frame;

setting a resistance applied to the flywheel in response to the rotating, wherein the resistance is based on a relative position of the adjustment bracket to the flywheel after the rotating the adjustment shaft;

sensing an angular displacement of the first linking member relative to the connecting member using a sensor disposed on the first connecting member adjacent to the distal end of the first linking member and a magnet disposed on the first distal end of the first linking member adjacent to the sensor, the sensed angular displacement corresponding to the relative position of the adjustment bracket to the flywheel; and calculating the resistance applied to the flywheel based at least in part on the sensed angular displacement.

9. The method of claim 8 wherein adjusting resistance further comprises disposing a pair of magnetic members on an inner surface of the adjustment bracket, each of the pair of magnetic members spaced from the flywheel by a distance, and wherein adjusting resistance further comprises adjusting the adjustment bracket creating magnetic flux between the pair of magnetic members disposed on opposite sides of the flywheel.

10. The method of claim 8 wherein adjusting further comprises connecting the first linking member to a mounting bracket connected to the frame.

11. The method of claim 8 wherein adjusting resistance further comprises disposing a brake pad on an inner surface of the adjustment bracket and rotating the adjustment shaft to apply a resistance to the flywheel by pushing the brake pad into the flywheel.

12. The method of claim 8 wherein adjusting the resistance further comprises manually turning a knob disposed at a second end of the adjustment shaft.

13. The method of claim 8 wherein sensing the angular displacement of the first linking member comprises sensing, using the sensor disposed adjacent to the distal end of the first linking member, a change in angular displacement of the magnet disposed on the distal of the first linking member adjacent to the sensor.

14. The method of claim 13 wherein the sensor is a Hall-effect sensor and wherein the magnet is a radially magnetized magnet.

15. The method of claim 14 further comprising transmitting information corresponding to the sensed position to a processing system.

16. A system comprising:

an adjusting bracket comprising a resistance member adapted to apply a variable resistance to a rotation of a flywheel, the applied resistance based, at least in part, on a distance between the resistance member and the flywheel;

a linking assembly connecting the adjusting bracket to a frame, the linking assembly configured to facilitate selective adjustment of the distance between the resistance member and the flywheel, the linking assembly comprising:

a first connecting member having a first end rotatably connected to the adjusting bracket;

a first linking member having a first distal end rotatably connected to a second end of the first connecting member at a rotation point, and a second distal end rotatably connected to the frame;

a magnetic sensor disposed on the first connecting member adjacent to the first distal end of the first linking member; and a magnet disposed on the first distal end of the first linking member adjacent to the magnetic sensor and configured to rotate about the rotation point in response to movement of the adjusting bracket;

wherein the magnetic sensor is configured to detect an angular displacement of the magnet relative to the magnetic sensor, the angular displacement corresponding to the selected distance between the resistance member and the flywheel.

17. The system of claim 16, wherein the adjusting member is adapted to move in a linear path towards the flywheel to increase resistance and away from the flywheel to reduce resistance.

18. The system of claim 17, further comprising an exercise apparatus comprising the frame and the flywheel, wherein the system further comprises:

a sleeve disposed on the frame and above the adjusting bracket relative to the flywheel;

an adjustment shaft comprising a threaded rod rotatably disposed through the tubular sleeve; and a threaded member mounted on the adjusting bracket and connected to a threaded portion of the threaded rod of the adjusting shaft;

wherein rotation of the adjustment shaft mechanically positions the adjusting bracket to set a desired resistance.

19. The system of claim 16, wherein the detected angular displacement corresponds to a resistance value of the adjusting bracket in the second position.

* * * * *